US007977813B2

(12) United States Patent
Bakken et al.

(10) Patent No.: US 7,977,813 B2
(45) Date of Patent: Jul. 12, 2011

(54) SYSTEM AND METHOD FOR REDUCING QUIESCENT POWER DRAW AND MACHINE USING SAME

(75) Inventors: Arick M. Bakken, Peoria, IL (US); Dwight D. Lemke, Chillicothe, IL (US); Joseph A. Willenborg, Peoria, IL (US); Amanda J. Wilke, Peoria, IL (US); Thomas J. Bickel, Lacon, IL (US); David L. Rottier, Washington, IL (US); Matthew A. Tobben, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 68 days.

(21) Appl. No.: 12/316,271

(22) Filed: Dec. 11, 2008

(65) Prior Publication Data

US 2010/0149716 A1 Jun. 17, 2010

(51) Int. Cl.
*B60L 1/00* (2006.01)

(52) U.S. Cl. ..... 307/10.1; 307/9.1

(58) Field of Classification Search ..... 307/9.1, 307/10.1

See application file for complete search history.

(56) References Cited

U.S. PATENT DOCUMENTS

| | | | | |
|---|---|---|---|---|
| 4,698,748 | A | 10/1987 | Juzswik et al. | |
| 5,072,703 | A | 12/1991 | Sutton | |
| 5,222,469 | A | 6/1993 | Sutton | |
| 5,619,412 | A | 4/1997 | Hapka | |
| 5,642,696 | A * | 7/1997 | Matsui | 123/179.1 |
| 5,670,845 | A | 9/1997 | Grant et al. | |
| 5,714,946 | A * | 2/1998 | Gottshall et al. | 340/870.16 |
| 5,834,854 | A | 11/1998 | Williams | |
| 5,939,998 | A | 8/1999 | Caporuscio et al. | |
| 5,999,876 | A | 12/1999 | Irons et al. | |
| 6,198,995 | B1 * | 3/2001 | Settles et al. | 701/29 |
| 6,249,106 | B1 * | 6/2001 | Turner et al. | 320/136 |
| 6,363,906 | B1 | 4/2002 | Thompson et al. | |
| 6,367,022 | B1 | 4/2002 | Gillespie et al. | |
| 6,400,589 | B2 * | 6/2002 | Abo et al. | 363/65 |
| 6,437,460 | B1 * | 8/2002 | Theofanopoulos et al. | 307/10.1 |
| 6,595,180 | B2 | 7/2003 | Thompson et al. | |
| 6,675,088 | B2 | 1/2004 | Miki | |
| 6,768,221 | B2 | 7/2004 | Klinger et al. | |
| 6,838,783 | B2 * | 1/2005 | Stierle et al. | 307/10.1 |
| 6,880,096 | B2 * | 4/2005 | Sumida | 713/320 |
| 7,058,831 | B2 * | 6/2006 | Cheok et al. | 713/320 |
| 7,116,009 | B2 * | 10/2006 | Tamai et al. | 307/10.7 |
| 7,236,893 | B2 * | 6/2007 | Gross et al. | 702/57 |
| 7,310,576 | B1 | 12/2007 | Letang | |
| 7,404,097 | B2 | 7/2008 | Yamamoto et al. | |
| 2003/0080621 | A1 * | 5/2003 | Kirk | 307/10.7 |
| 2004/0078126 | A1 | 4/2004 | Huber et al. | |
| 2004/0148083 | A1 | 7/2004 | Arakawa et al. | |
| 2005/0222733 | A1 | 10/2005 | Merten et al. | |
| 2007/0140670 | A1 | 6/2007 | DeDona et al. | |
| 2008/0201023 | A1 | 8/2008 | Berglund | |

FOREIGN PATENT DOCUMENTS

| | | |
|---|---|---|
| JP | 03059924 | 3/1991 |
| WO | 03060243 | 7/2003 |
| WO | 2007139167 | 12/2007 |

* cited by examiner

*Primary Examiner* — Jared J Fureman
*Assistant Examiner* — Adi Amrany
(74) *Attorney, Agent, or Firm* — Liell & McNeil

(57) ABSTRACT

A machine includes a plurality of electronic controllers electrically connected to an electrical power source along a first electrical circuit through a first relay and along a second electrical circuit through a second relay. A relay controller is directly connected to the electrical power source along a third electrical circuit, and is in communication with the first relay and the second relay. The relay controller is configured to open or close the first relay or the second relay in response to a power requirement indication.

15 Claims, 6 Drawing Sheets

SYSTEM AND METHOD FOR REDUCING QUIESCENT POWER DRAW AND MACHINE USING SAME

TECHNICAL FIELD

The present disclosure relates generally to reducing quiescent power draw, and more particularly to a method for reducing quiescent power draw in machines having a plurality of electronic controllers.

BACKGROUND

An electronic controller is well known in the industry for collecting and processing data relevant, and often critical, to proper machine operation. Such data may include, for example, engine speed, fuel/air mixture, temperature, and various other parameters. The data, after collected and processed, can be used to evaluate the performance of the machine and, more specifically, the engine. More recently, with the implementation of emission control requirements, electronic controllers are commonly used to facilitate more efficient operation of the engine by affecting control decisions based on the data it has collected and processed. These sophisticated electronic controllers consist of central processing units and assorted inputs and outputs dedicated to controlling various components within the engine system of a machine.

The desire to provide such precise control to various other systems, or subsystems, of a machine has led to the implementation of multiple electronic controllers. Although there are a number of benefits to utilizing more than one electronic controller, multiple electronic controllers may cause a significant power draw on the electrical system of the machine. Specifically, for example, when the engine is off and the battery is not being continuously charged, the quiescent power draw from each electronic controller may reduce battery life. In machines utilizing multiple electronic controllers, this quiescent power draw may become quite significant. For example, if the engine has not been started for a period of time, and, therefore, the battery recharged, the power draw may deplete the battery and an operator may be unable to start the machine.

U.S. Pat. No. 5,834,854 teaches a system for reducing electrical power to electronic modules after a "key-off" of a motor vehicle. Specifically, an electrical power input of each of a plurality of electronic modules is switchably coupled to a vehicle system voltage. During "key-on," the switchable connection to the vehicle system voltage is closed, thereby providing "key-on" power for the modules from the system voltage. During "key-off," the switchable connection is opened, thereby providing "key-off" power for the electronic modules from a switching power supply. The "key-off" power provided through the switching power supply may represent a reduced amount of power relative to the "key-on" power. It should be appreciated, however, that there remains a continuing need for improved strategies for reducing quiescent power draw in machines having electronic control systems.

The present disclosure is directed to one or more of the problems set forth above.

SUMMARY OF THE DISCLOSURE

In one aspect, a machine includes a plurality of electronic controllers electrically connected to an electrical power source along a first electrical circuit through a first relay and along a second electrical circuit through a second relay. A relay controller is directly connected to the electrical power source along a third electrical circuit, and is in communication with the first relay and the second relay. The relay controller is configured to open or close the first relay or the second relay in response to a power requirement indication.

In another aspect, a method of operating a machine includes a step of supplying electrical power from an electrical power source directly to a relay controller, while a plurality of electronic controllers are electrically disconnected from the electrical power source to, at least partially, reduce a quiescent power draw. A first activation command is communicated from the relay controller to a first relay in response to a power requirement indication. The first relay is closed to electrically connect the electrical power source and the plurality of electronic controllers in response to the first activation command.

In yet another aspect, an electronic control system of a machine includes a plurality of electronic controllers electrically connected to an electrical power source along a first electrical circuit through a main power relay and along a second electrical circuit through a low current mode relay. A relay controller has a direct electrical connection to the electrical power source along a third electrical circuit, and is electrically connected to the electrical power source along a fourth electrical circuit through an ignition key switch. The relay controller, in communication with the main power relay and the low current mode relay, is configured to close at least one of the main power relay and the low current mode relay in response to detection of an on position of the ignition key switch or receipt of a wake up signal from a wake up component.

DETAILED DESCRIPTION

Figure 1:
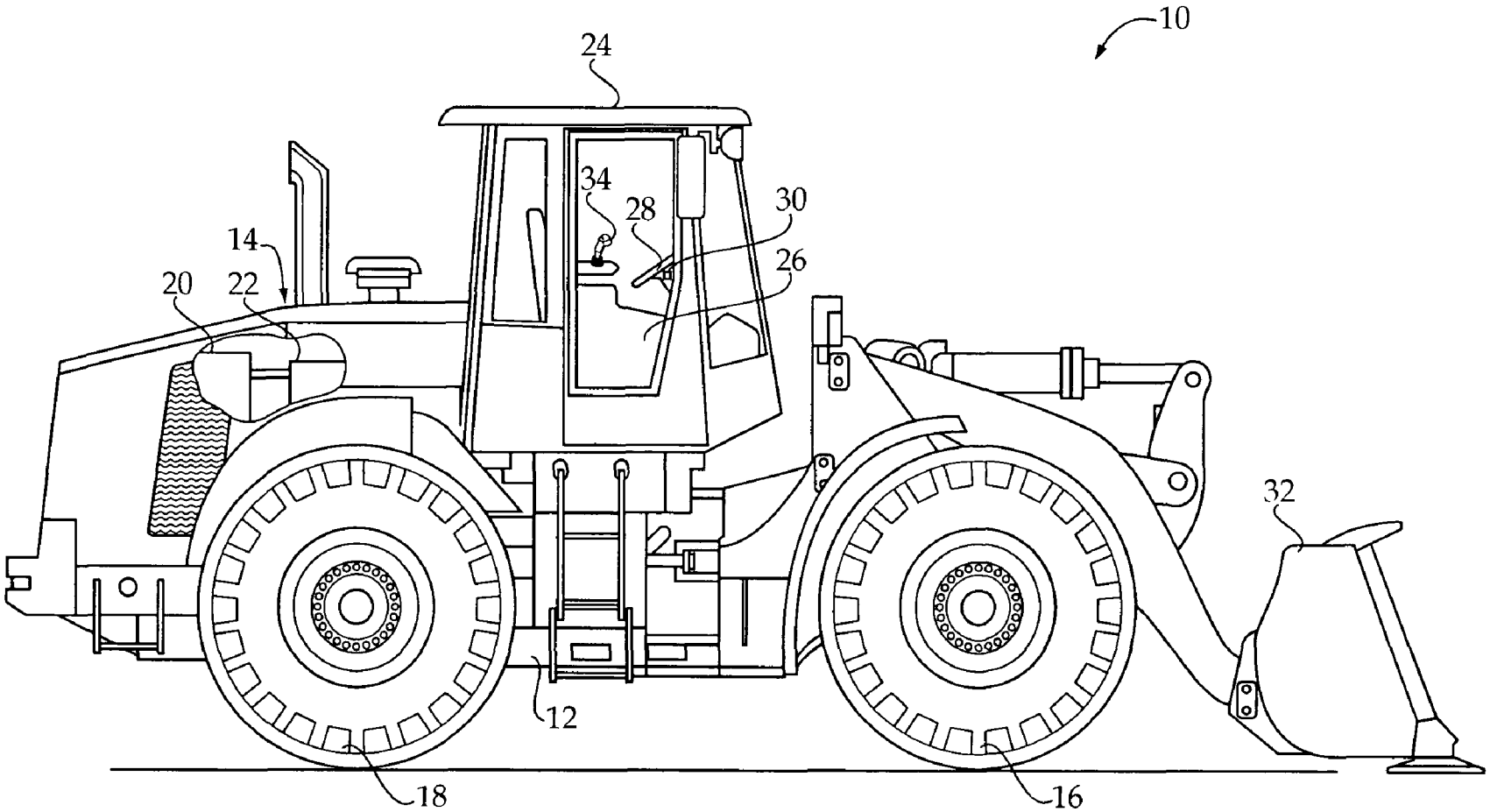
FIG. 1 is a side diagrammatic view of a machine, according to the present disclosure.

An exemplary embodiment of a machine 10 is shown generally in FIG. 1. The machine 10 may be a wheel loader, as shown, or any other on-highway or off-highway vehicle used to perform work operations. In the illustrated embodiment, machine 10 includes a machine body, or frame, 12 having a drive system 14 supported thereon for driving ground engaging elements of the machine 10, such as, for example, front wheels 16 or rear wheels 18. Drive systems, such as drive system 14, are known and typically include an internal combustion engine 20, or other power source, configured to transmit power to a transmission 22. The transmission 22, in turn, may be configured to transmit power to one or more ground engaging elements, such as the front wheels 16 or rear wheels 18, through one or more axles, differentials, and final drives.

An operator control station 24 may be mounted on the machine body 12 and may include common devices, such as, for example, a seat assembly 26 and a steering device 28 that facilitate operator control of the machine 10. An ignition key switch 30, which may include at least an on position and an off position, may be provided for starting and shutting down the internal combustion engine 20. The operator control station 24 may include various other machine operation controllers, such as, for example, a throttle for selecting an engine speed of the internal combustion engine 20. Additional machine operation controllers may be provided for controlling a direction or movement of the machine 10, such as a forward, neutral, or reverse direction, and/or controlling operation of an implement 32, such as a loader, of the machine 10. A switch 34, and additional controls, may also be provided within the operator control station 24 for controlling one or more electrical components, such as, for example, one or more lights of the machine 10.

Figure 2:
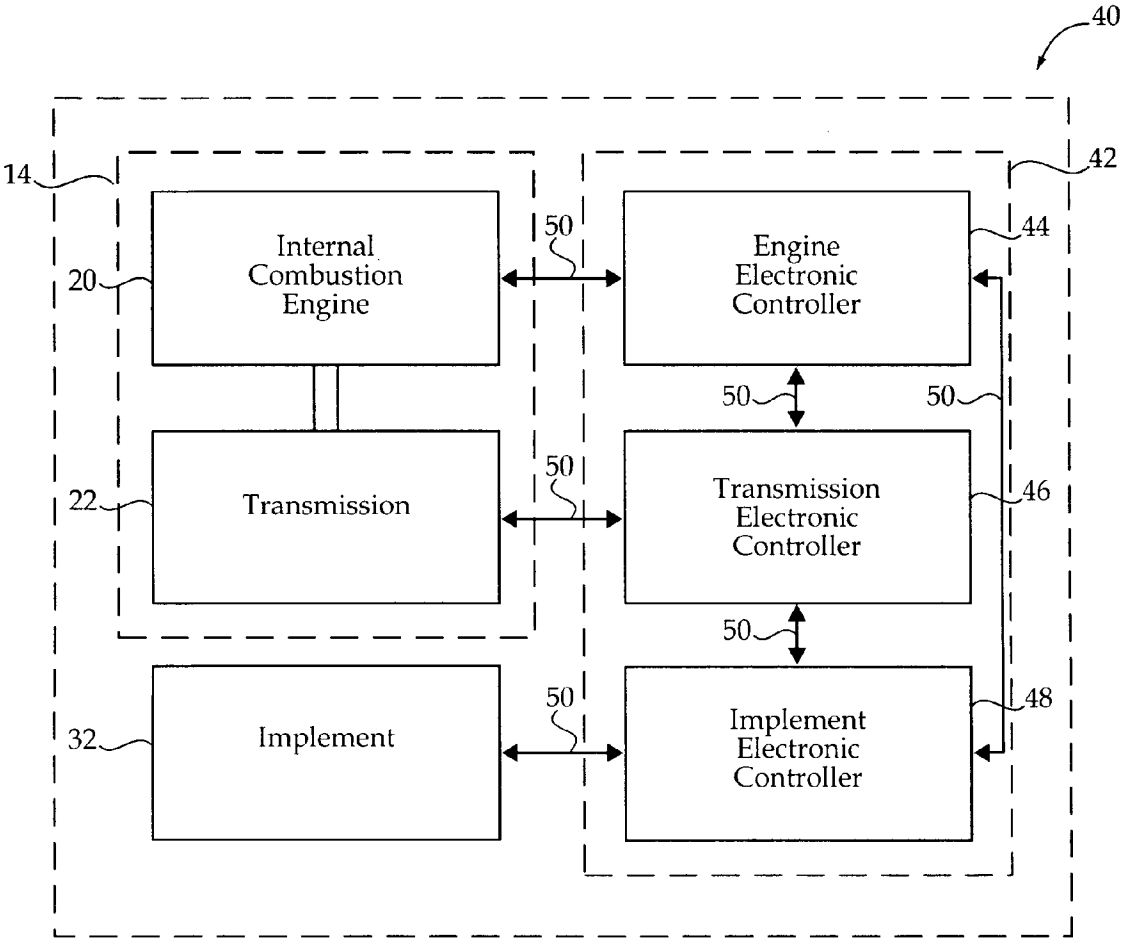
FIG. 2 is a block diagram of an exemplary electronic control system for a machine, such as the machine of FIG. 1, according to the present disclosure.

Turning now to FIG. 2, an exemplary control system for controlling the drive system 14, and other components, of machine 10 is shown generally at 40. Specifically, the control system 40 may include an electronic control system 42 comprising a plurality of electronic controllers for controlling one or more of the various components or systems of machine 10. For example, the electronic control system 42 may include an engine electronic controller 44 for controlling one or more operational aspects of the internal combustion engine 20, and a transmission electronic controller 46 for controlling operation of the transmission 22 and/or additional components of the drive system 14. The electronic control system 42 may also include an implement electronic controller 48 for controlling various operational aspects of the implement 32 and/or hydraulic system, which may be used to control implement 32. Although specific electronic controllers 44, 46, and 48 are shown, it should be appreciated that the electronic control system 42 may include any number of electronic controllers for controlling any of various operational aspects of machine 10.

Each electronic controller 44, 46, and 48 may be of standard design and may include a processor, such as, for example, a central processing unit, a memory, and an input/output circuit that facilitates communication internal and external to the electronic controllers 44, 46, and 48. The processors, for example, may control operation of the electronic controllers 44, 46, and 48 by executing operating instructions, such as, for example, computer readable program code stored in memories, wherein operations may be initiated internally or externally to the electronic controllers 44, 46, and 48. Control schemes may be utilized that monitor outputs of systems or devices, such as, for example, sensors, actuators, or control units, via the input/output circuit to control inputs to various other systems or devices. Memories, as used herein, may comprise temporary storage areas, such as, for example, cache, virtual memory, or random access memory, or permanent storage areas, such as, for example, read-only memory, removable drives, network/internet storage, hard drives, flash memory, memory sticks, or any other known volatile or non-volatile data storage devices. One skilled in the art will appreciate that any computer based system or device utilizing similar components for controlling the machine systems or components described herein, is suitable for use with the present disclosure.

The electronic controllers 44, 46, and 48, and additional electronic controllers of the electronic control system 42, may communicate via one or more wired and/or wireless communications lines 50, or other similar input/output circuits. Further, each of the electronic controllers 44, 46, and 48 may communicate with one or more sensors, or other devices, associated with the specific machine system controlled by electronic controllers 44, 46, and 48. For example, the engine electronic controller 44 may communicate with various sensors and/or devices via communications lines 50, as necessary to evaluate and/or control performance of the internal combustion engine 20, or engine system in general. Similarly, the transmission electronic controller 46 may communicate with one or more sensors or devices of the transmission 22, and/or additional components of the drive system 14, to control operation of the transmission 22. The implement electronic controller 48, which may include or communicate with a hydraulic system electronic controller, may be configured to evaluate and control operation of the implement 32 by communicating with one or more machine operation controllers, as described above, and/or one or more components of a hydraulic system.

Figure 3:
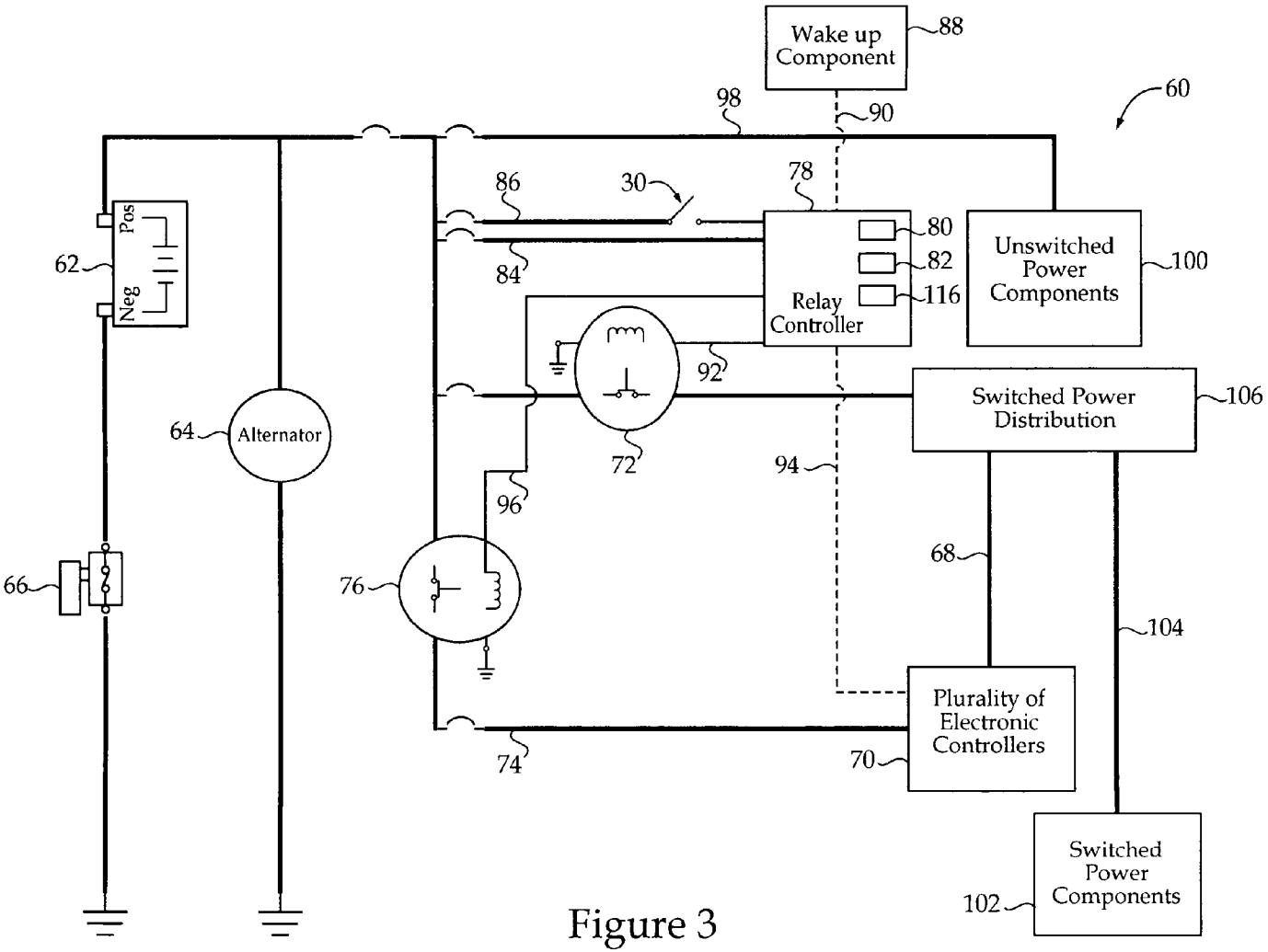
FIG. 3 is a schematic of an exemplary electrical power system of the machine of FIG. 1, according to the present disclosure.

An electrical power system, which may be configured to provide electrical power to the electronic control system 42, and other components of machine 10 requiring electrical power, is shown generally at 60 in FIG. 3. The electrical power system 60 may include an electrical power source 62, such as, for example, a battery, and an alternator 64, or other electrical power generator for supplying power to the electrical power source 62. Specifically, for example, alternator 64 may be driven by the internal combustion engine 20 (FIG. 1) to charge the electrical power source 62. A disconnect switch 66, as is known in the art, may also be provided for manually disconnecting the electrical power source 62 from the electrical power system 60. According to one embodiment, the disconnect switch 66 may be actuated prior to servicing or storing the machine 10.

The electrical power system 60 may also include a first electrical circuit 68 electrically connecting the electrical power source 62 and a plurality of electronic controllers 70 through a first relay, such as a main power relay 72, or other electrical switching device. The plurality of electronic controllers 70 may include any or all of the electronic controllers of electronic control system 42, such as, for example, the engine electronic controller 44, the transmission electronic controller 46, and the implement electronic controller 48. The plurality of electronic controllers 70 may also be electrically connected to the electrical power source 62 along a second electrical circuit 74 through a second relay, such as a low current mode relay 76. The low current mode relay 76, according to the exemplary embodiment, may be configured to switch a lower current, or draw, of electrical power to the plurality of electronic controllers 70. For example, the electrical power provided along the second electrical circuit 74, through the low current mode relay 76, may provide a current draw that is less than a current draw provided along the first electrical circuit 68, through the main power relay 72.

A relay controller 78 may also be provided for controlling one or more components or devices, such as the main power relay 72 and the low current mode relay 76, of the electrical power system 60 and/or the electronic control system 42. The relay controller 78, according to one embodiment, may be one of the electronic controllers of electronic control system 42, such as, for example, the engine electronic controller 44, the transmission electronic controller 46, or the implement electronic controller 48. Such a selection may be arbitrary or may be based on specific operations performed by the selected electronic controller. As such, the relay controller 78 may include an operations module 80 and a relay control module 82. Specifically, the operations module 80 may be configured to primarily control and/or monitor operations associated with the specific machine system controlled by the controller 78, as described above, while the relay control module 82 may be configured to control distribution of electrical power from the electrical power source 62 to various electrical components of the machine 10, including other controllers of the plurality of electronic controllers 70. Alternatively, however, the relay controller 78 may be a control module that is independent from the electronic controllers of the electronic control system 42 and, therefore, is exclusively configured to control electrical components or devices, such as the main power relay 72 and the low current mode relay 76, of machine 10.

According to the exemplary embodiment, the relay controller 78 may be electrically connected, such as through an uninterrupted electrical connection, to the electrical power source 62 along a third electrical circuit 84. In addition, a fourth electrical circuit 86 may electrically connect the relay controller 78 and the electrical power source 62 though the ignition key switch 30, described above, which includes at least an on position and an off position. As such, the relay controller 78 or, according to a specific example, the relay control module 82 may be configured to monitor the fourth electrical circuit 86 to detect a position of the ignition key switch 30. For example, if the fourth electrical circuit 86 is closed, an on position of the ignition key switch 30 may be indicated, or if the fourth electrical circuit 86 is open, an off position of the ignition key switch 30 may be determined. It should be appreciated that the ignition key switch 30 may include additional, or alternative, positions that may be incorporated into the control strategy described below.

A wake up component 88, which may represent any component or device configurable to transmit a signal, such as a wake up signal, to the relay controller 78, may also be provided. Specifically, for example, the wake up component 88 may include an electronic component or device that is located internal or external to machine 10 that may be configured to transmit a wake up signal to the relay controller 78 via a communications channel, or circuit, 90. Such a wake up signal, for example, may be provided as a power requirement indication to the relay controller 78 and, as such, may indirectly affect control of the main power relay 72 and/or the low current mode relay 76. According to a specific example, the relay controller 78 may be configured, or programmed, to open or close the main power relay 72, such as via a communications channel, or circuit, 92, in response to the wake up signal. Alternatively, or additionally, the relay controller 78 may be configured to open or close the main power relay 72 in response to a signal received from one of the plurality of electronic controllers 70 via communications channel, or circuit, 94, a detected position of the ignition key switch 30, and/or any other power requirement indications provided to the relay controller 78.

The relay controller 78, as described herein, may also be configured to open or close the low current mode relay 76, such as via an additional communications channel, or circuit, 96. More specifically, the relay controller 78 may be configured to open or close the low current mode relay 76 in response to one or more power requirement indications, as described above. For example, the relay controller 78, receiving continuous electrical power from the electrical power source 62, may be configured, or programmed, to selectively control electrical power provided to the plurality of electronic controllers 70, by controlling the low current mode relay 76, and main power relay 72, based on certain predetermined indications of electrical power requirements. As such, the relay controller 78 may ensure that an appropriate amount of electrical power is provided to the plurality of electronic controllers 70 only when it is deemed necessary. It should be appreciated that the relay controller 78 may close or open the low current mode relay 76 and/or the main power relay 72 by energizing, or de-energizing, coils within the relays 76 and 72, thus closing, or opening, contacts within the respective relays 76 and 72.

The electrical power system 60 may also include a fifth electrical circuit 98 electrically connecting the electrical power source 62 and a plurality of un-switched power components 100 through an uninterrupted, or un-switched, electrical connection, as shown. Un-switched power components 100 may include any electrical components, such as, for example, lights, horn, radio, and hood actuator components, that may receive power directly from the electrical power source 62, such as along the fifth electrical circuit 98. It should be appreciated that it may be desirable to continue to provide electrical power to a number of electrical components of machine 10, even when the internal combustion engine 20 (FIGS. 1 and 2) is not running and/or the ignition key switch 30 is in the off position. As such, un-switched power components 100 may be directly connected to the electrical power source 62, as shown.

The electrical power source 62 may also provide electrical power to a number of switched power components 102, other than the plurality of electronic controllers 70 of electronic control system 42. Specifically, a sixth electrical circuit 104 may electrically connect the switched power components 102 to the electrical power source 62 through the main power relay 72. As with the plurality of electronic controllers 70, it may be desirable to disconnect the switched power components 102 from the electrical power source 62 under certain conditions, such as, for example, when the internal combustion engine 20 (FIGS. 1 and 2) is not running and/or when the ignition key switch 30 is in the off position. Such switched power components 102 may include, for example, heated mirrors, HVAC system, heated seats, wipers, and various other electrical components. Since the plurality of electronic controllers 70 are also receiving electrical power through the main power relay 72, it may be desirable to distribute the switched electrical power to the plurality of electronic controllers 70 and the other switched power components 102 through a switched power distribution component 106.

Figure 4:
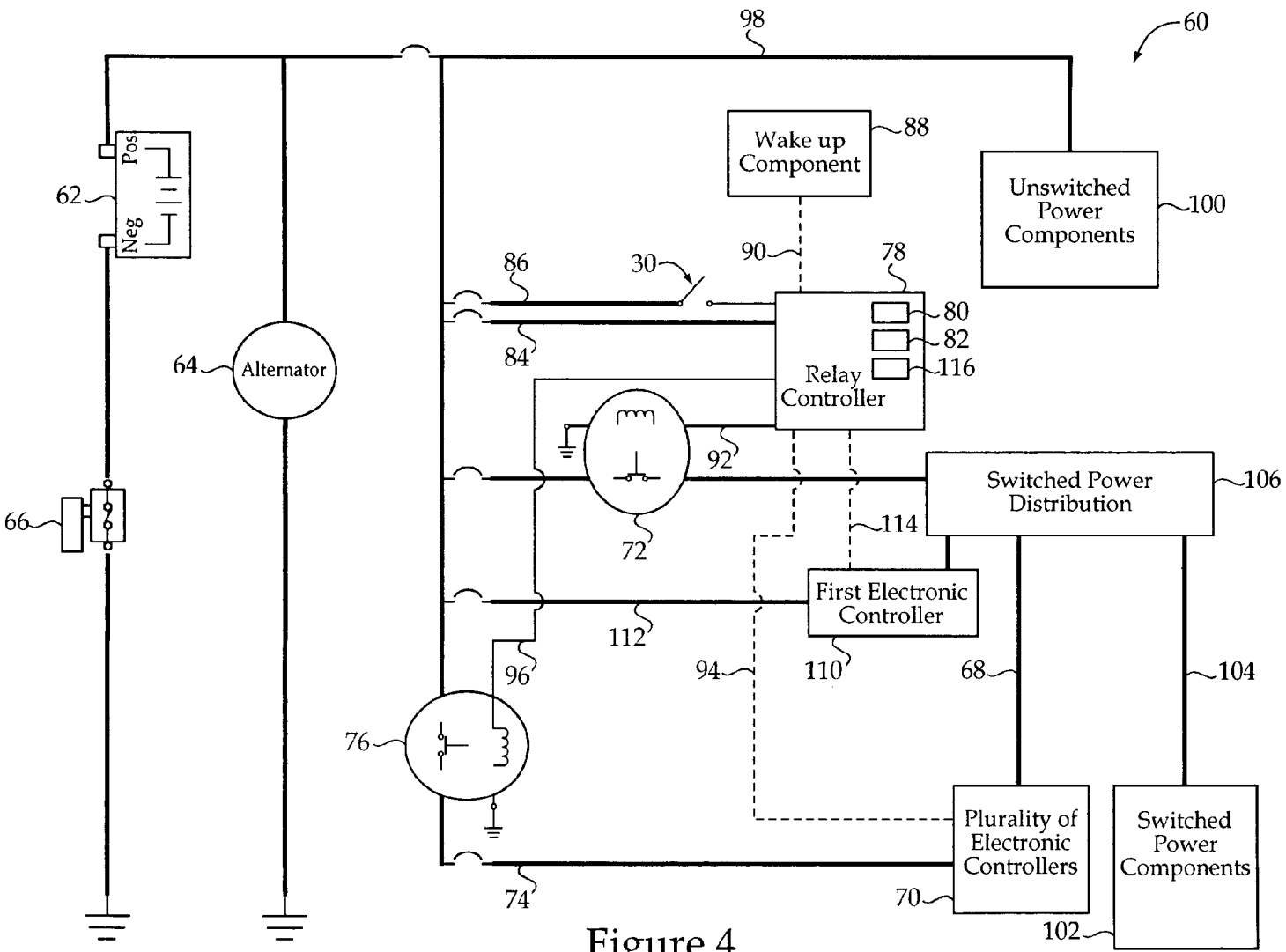
FIG. 4 is a schematic of an alternative embodiment of an electrical power system of the machine of FIG. 1, according to the present disclosure.

An alternative configuration of electrical power system 60 is shown generally in FIG. 4. According to this embodiment, one of the plurality of electronic controllers 70, such as a first electronic controller 110, may be directly connected to the electrical power source 62 along a seventh electrical circuit 112 and may receive switched power through component 106. According to yet alternative embodiments, additional electronic controllers, in addition to the first electronic controller 110, may be directly connected to the electrical power source 62. As described with respect to the embodiment of FIG. 3, the relay controller 78 may monitor the ignition key switch 30 and/or may be responsive to the wake up component 88, which may or may not have a direct electrical connection to the electrical power source 62, to control the main power relay 72 and/or the low current mode relay 76. Further, the relay controller 78 may communicate with the first electronic controller 110 via a communications channel or circuit 114. The first electronic controller 110 may be configured to communicate information to the relay controller 78 and/or transmit commands, such as operational commands, to the relay controller 78.

According to one example, the relay controller 78 may be configured, or programmed, to transition the first electronic controller 110 between various operating states based on one of the power requirement indications described above. Specifically, for example, the relay controller 78 may transition the first electronic controller 110 to a sleep state, during which a limited number of operations are performed, when the ignition key switch 30 is in the off position, and may "wake-up," or transition, the first electronic controller 110 to an operating state, during which a larger number of operations are performed, when the ignition key switch 30 is in the on position. Such an electronic controller 110, however, may, through electrical circuit 112, continuously receive electrical power from the electrical power source 62.

Figure 5:
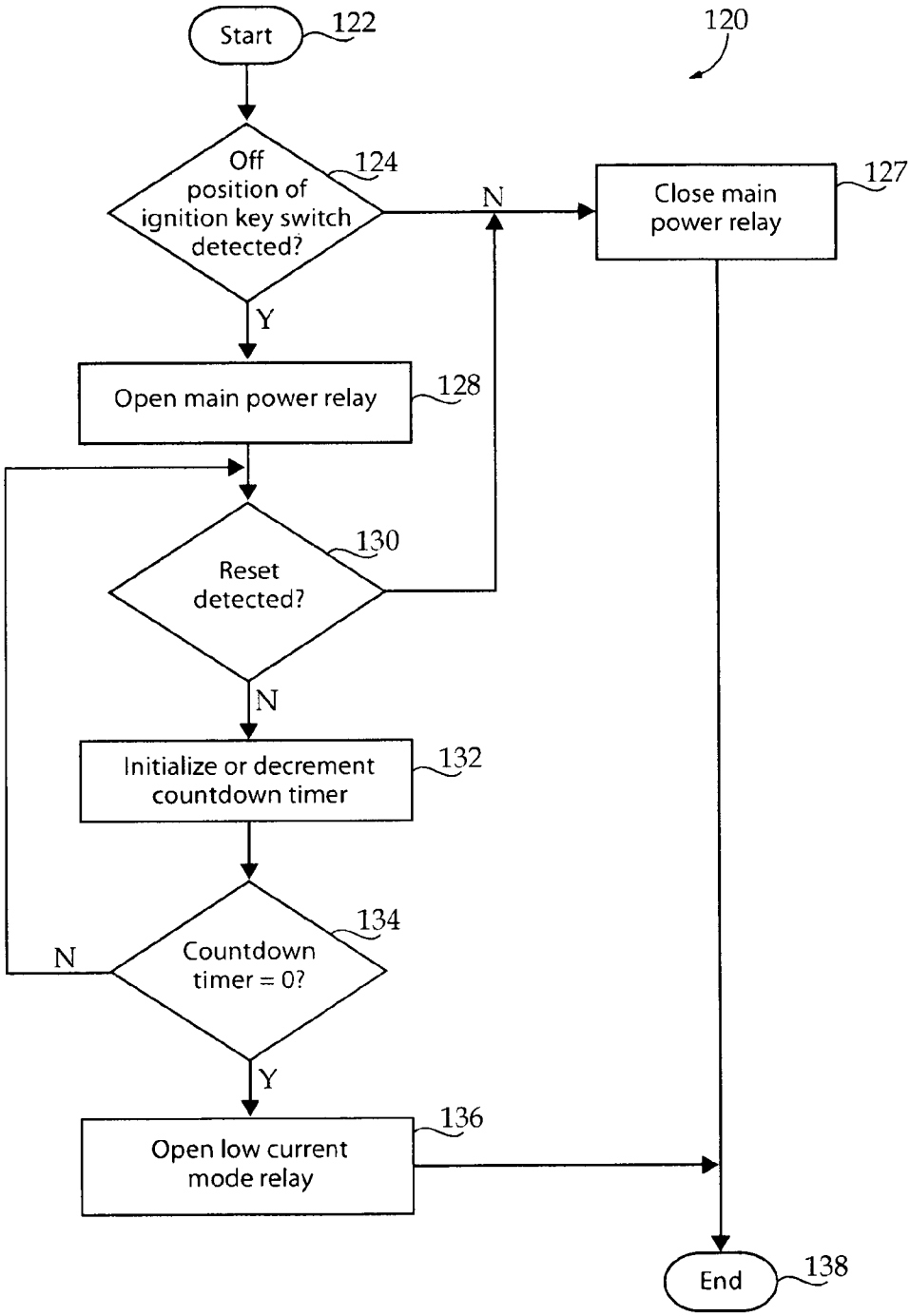
FIG. 5 is a logic flow chart of one embodiment of a method for controlling the electrical power systems of FIGS. 4 or 5, according to the present disclosure.

Turning now to FIG. 5, and referring also to FIGS. 1-4, there is shown a logic flow diagram 120 representing an exemplary method for controlling the electrical power system 60 of machine 10, according to the present disclosure. The method may be implemented by the control system 40 or, more specifically, the electronic control system 42 of the machine 10. According to one example, the steps implementing the disclosed method may be in the form of computer readable program code stored in one of the memories of the electronic controllers, such as engine electronic controller 44, transmission electronic controller 46, or implement electronic controller 48, of electronic control system 42 and executed by the respective processor of the electronic controllers, or other computer usable medium. According to an alternative example, the steps implementing the method may be stored and executed on a module or controller, such as relay controller 78, which may or may not be independent from one of the electronic controllers of electronic control system 42. The method may run continuously or may be initiated in response to one or more predetermined events, as described below.

The method begins at a START, Box 122. From Box 122, the method proceeds to Box 124, which includes the step of detecting an off position of the ignition key switch 30. Specifically, according to one embodiment, the relay controller 78 may be electrically connected to the electrical power source 62 through the ignition key switch 30. As such, the relay controller 78 may be configured to detect a transition of the ignition key switch 30 to the off position. Until the off position is detected, the relay controller 78 may maintain a closed position of the main power relay 72, at Box 126, thus providing power to the plurality of electronic controllers 70 and other switched power components 102 through the main power relay 72. It should be appreciated that, during an on position of the ignition key switch 30, the low current mode relay 76 may also remain closed, thus providing continuous electrical power to the plurality of electronic controllers 70 and the other switched power components 102 when the main power relay 72 is opened.

If the off position of the ignition key switch 30 is detected, at Box 124, the method proceeds to Box 128, where the relay controller 78 opens the main power relay 72, such as by communicating an activation command to the main power relay 72, in response to the off position of the ignition key switch 30. The main power relay 72 may be opened immediately or, alternatively, a predetermined period of time after the off position is detected. As a result, the plurality of electronic controllers 70 and other switched power components 102 are disconnected from the electrical power source 62 through the main power relay 72. It should be appreciated, however, that the plurality of electronic controllers 70 may continue to receive electrical power through the low current mode relay 76. Such power, as described above, may be a lower power than the electrical power provided through the main power relay 72. Thus, by receiving electrical power only along the fourth electrical circuit 74, the plurality of electronic controllers 70 may draw less electrical power from the electrical power source 62 during the off position of the ignition key switch 30.

At Box 130, the method determines if a reset is detected. A reset, according to one embodiment, may include detection of a subsequent on position of the ignition key switch 30. If the on position is detected, as should be appreciated, the main power relay 72 may again be closed, at Box 127, to provide electrical power to the switched power components 102, and to provide a higher voltage of electrical power to the plurality of electronic controllers 70. According to some embodiments, a reset may also include receipt of a wake up signal from the wake up component 88, or other power requirement indication provided to relay controller 78. If a reset is not detected, the method proceeds to Box 132, where, according to one embodiment, a countdown timer 116 (FIGS. 3 and 4) may be initialized. The countdown timer 116 may represent any timer process, such as a method implemented by the processor of relay controller 78, which may be synchronized with a system clock, as is known in the art.

After the countdown timer 116 is initialized to a predetermined value, at Box 132, the method proceeds to Box 134. At Box 134, the method determines if the countdown timer 116 equals zero. If the countdown timer 116 equals zero, the method proceeds to Box 136. Otherwise, the method step at Box 130 is repeated, and the countdown timer 116 is decremented, at Box 132, until the countdown timer 116 reaches zero. It should be appreciated that the countdown timer 116 may be initialized to any desired value, such as, for example, a time period selected to allow completion of procedures or updates running on the plurality of electronic controllers 70. Alternatively, however, the method may proceed in response to receipt of one or more system messages, rather than after a lapse of a predetermined period of time. After the selected time period has expired or one or more anticipated system messages have been received, the low current mode relay 76 may be opened, at Box 136. By opening the low current mode relay 76, all electrical power to the plurality of electronic controllers 70 is removed. According to one embodiment, the relay controller 78 may transmit a deactivation command to the low current mode relay 76 to electrically disconnect the plurality of electronic controllers 70 from the electrical power source 62. After the low current mode relay 76 is opened, the method may proceed to an END, at Box 138.

Figure 6:
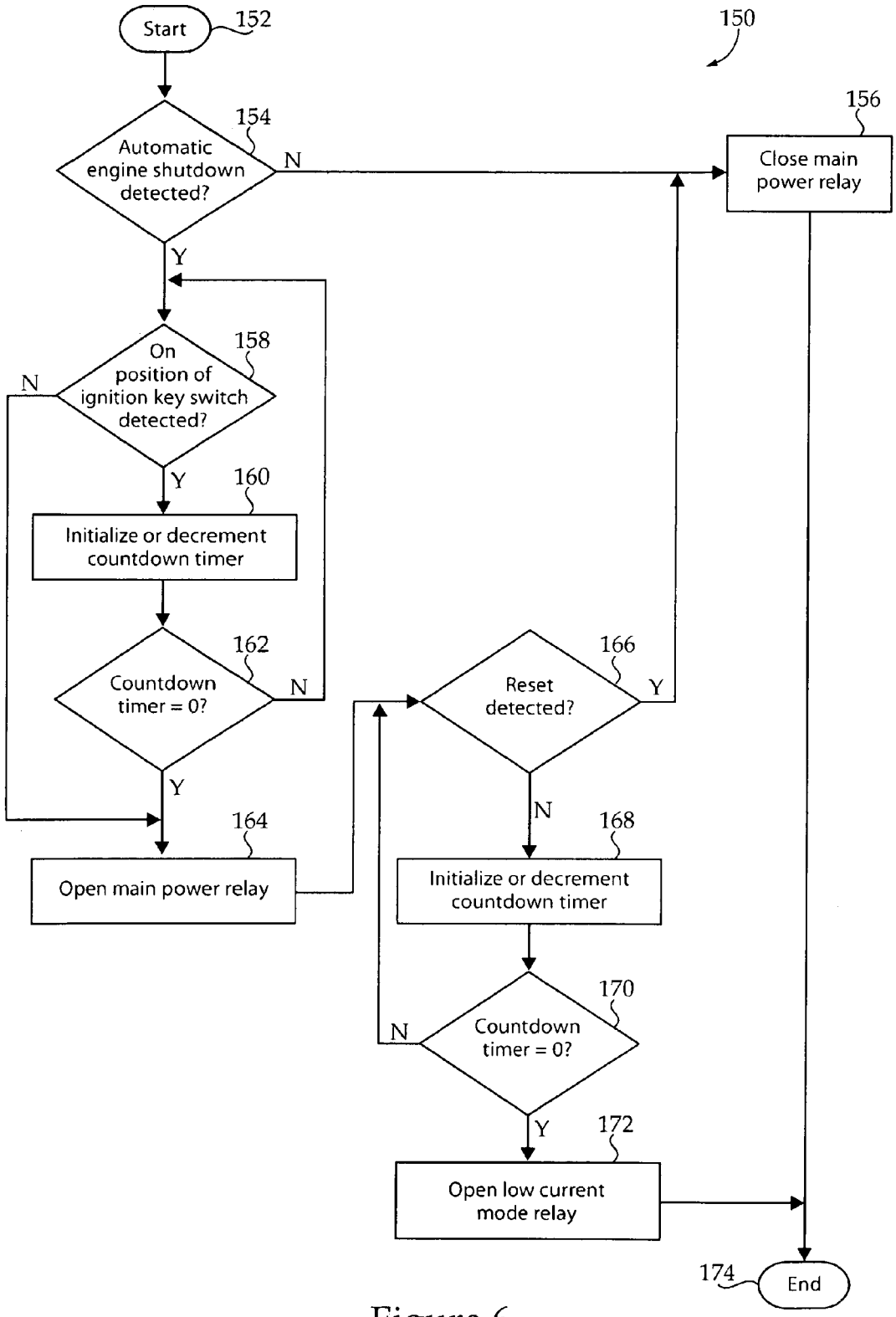
FIG. 6 is a logic flow chart of an additional method for controlling the electrical power systems of FIG. 4 or FIG. 5, according to the present disclosure.

An additional method for controlling the electrical power system 60 of machine 10 is shown generally at 150 in FIG. 6. The method, as shown, begins at a START, Box 152. From Box 152, the method proceeds to Box 154. At Box 154, the method determines if an automatic engine shutdown is detected. According to one embodiment, an automatic shutdown of the internal combustion engine 20 may be commanded by the engine electronic controller 44 after the machine 10 has been in an idling state for an extended period of time. The relay controller 78 may be configured to monitor specific machine parameters or query the engine electronic controller 44 to identify such a shutdown condition. Until the automatic engine shutdown is detected, the relay controller 78 may maintain a closed position of the main power relay 72, at Box 156, thus providing power to the plurality of electronic controllers 70 and other switched power components 102 through the main power relay 72.

If, however, the automatic engine shutdown is detected, the method proceeds to Box 158. At Box 158, the method determines if an on position of the ignition key switch 30 is detected. If the ignition key switch 30 remains in the on position after the automatic engine shutdown, the method proceeds to Box 160. Otherwise, if an off position of the ignition key switch 30 is detected, the method described above with reference to FIG. 5 may be initiated. At Box 160, the countdown timer 116, described above, may be initialized to a predetermined value. After the countdown timer 116 is initialized at Box 160, the method proceeds to Box 162. At Box 162, the method determines if the countdown timer 116 equals zero. If the countdown timer 116 equals zero, the method proceeds to Box 164. Otherwise, the method step at Box 158 is repeated, and the countdown timer 116 is decremented, at Box 160, until the countdown timer 116 reaches zero.

Once the countdown timer 116 reaches zero, or the off position of the ignition key switch 30 is detected at Box 158, the method proceeds to Box 164, where the main power relay 72 is opened. Alternatively, however, the main power relay 72 may be opened in response to receipt of one or more anticipated system messages or signals. As a result, power to the plurality of electronic controllers 70 and other switched power components 102, through the main power relay 72, is removed. It should be appreciated, however, that the plurality of electronic controllers 70 remain electrically connected to the electrical power source 62 through the low current mode relay 76. Such power, as described above, may be less power than the electrical power provided through the main power relay 72. Thus, by receiving electrical power only along the fourth electrical circuit 74, the plurality of electronic controllers 70 may draw a reduced current of electrical power from the electrical power source 62 after the automatic engine shutdown is detected.

At Box 166, the method determines if a reset, such as an off position of the ignition key switch 30 followed by a subsequent on position, or a wake up signal, is detected. If a reset is detected, the main power relay 72 may again be closed, at Box 156, to provide electrical power to the plurality of electronic controllers 70 and switched power components 102 through the main power relay 72. If, however, a reset is not detected, the method proceeds to Box 168, where the countdown timer 116 is initialized. After the countdown timer 116 is initialized to a predetermined value at Box 168, the method proceeds to Box 170. At Box 170, the method determines if the countdown timer 116 equals zero. If the countdown timer 116 equals zero, the method proceeds to Box 172. Otherwise, the method step at Box 166 is repeated, and the countdown timer 116 is decremented, at Box 168, until the countdown timer 116 reaches zero. Alternatively, however, the method may proceed in response to receipt of one or more system messages, rather than after a lapse of a predetermined period of time. After the selected time period has expired or one or more anticipated system messages have been received, the low current mode relay 76 is opened, at Box 172. As a result, all electrical power to the plurality of electronic controllers 70 is removed. After the low current mode relay 76 is opened, the method proceeds to an END, at Box 174.

It should be appreciated that one or both of the methods described herein may be implemented by the relay controller 78, or other similar component, of the electrical power system 60, such as exemplified in FIGS. 3 and 4. Specifically, the relay controller 78 may be configured to execute computer readable code for disconnecting electrical components, such as electronic controllers 70, from the electrical power source 62 in response to an off position of the ignition key switch 30, or in response to detection of an automatic engine shutdown, as described above. According to one embodiment, the relay controller 78 may be configured to first disconnect main power to the plurality of electronic controllers 70, thus providing less electrical power through low current mode relay 76, and next disconnect those electronic controllers 70 from all electrical power. After such a transition, the relay controller 78 may also be configured to transition from an operating state, during which a larger number of operations are performed, to a sleep state, in which a limited number of operations are performed, thus further reducing quiescent power draw of electrical power source 62.

After either or both of the methods described herein have been implemented to remove electrical power from the plurality of electronic controllers 70, power may again be restored in any of a number of ways. For example, in response to an on position of the ignition key switch 30, the relay controller 78 may be configured to close at least one of the main power relay 72 and the low current mode relay 76 to provide electrical power to the plurality of electronic controllers 70. Alternatively, or additionally, the relay controller 78 may close one or both of relays 72 and 76 in response to a wake up signal received from the wake up component 88, which may include, for example, the switch 34, a key fob, seat switch, door switch, satellite signal, or other similar device or system. Such power requirement indications, as described herein, may provide the relay controller 78 with current, or imminent, electrical requirements of the plurality of electronic controllers 70.

INDUSTRIAL APPLICABILITY

The present disclosure may find potential application in any on-highway or off-highway machine designed to perform work operations. Further, the present disclosure may be applicable to machines having electronic control systems including a plurality of electronic controllers. Yet further, the present disclosure may apply to machines that may experience significant quiescent power draw, such as from one or more of the electronic controllers, during an off position of an ignition key switch of the machine. In addition, the present disclosure may be applicable to machines implementing an automatic engine shutdown procedure, during which the ignition key switch may remain in an on position. Such machines may include, but are not limited to, off-highway machines, such as wheel loaders, on-highway machines, stationary applications, and other machines known in the art.

Referring generally to FIGS. 1-6, a machine 10 may include an electronic control system 42 comprising one or more electronic controllers, such as an engine electronic controller 44, a transmission electronic controller 46, and an implement electronic controller 48, for controlling various operational aspects of the machine 10. During a typical operation of the machine 10, an operator may transition an ignition key switch 30, within an operator control station 24, from an off position to an on position, such as to start the internal combustion engine 20. In response, a relay controller 78, which may include one of the plurality of electronic controllers, may close both a main power relay 72 and a low current mode relay 76, thus providing electrical power from an electrical power source 62 to a plurality of electronic controllers 70 and other switched power components 102. According to one embodiment, a relay controller 78 may communicate activation commands to the main power relay 72 and low current mode relay 76, causing both relays 72 and 76 to close, thus electrically connecting the plurality of electronic controllers 70, and other switched power components 102, with the electrical power 62 through the main power relay 72 and the low current mode relay 76.

After performing one or more operations, and according to one example, the operator may switch the ignition key switch 30 to an off position, which may be detected by the relay controller 78, as described above. In response, the relay controller 78 may communicate a deactivation command to the main power relay 72, causing the main power relay 72 to electrically disconnect the plurality of electronic controllers 70 and the switched power components 102 from the electrical power source 62 through the main power relay 72. It should be appreciated that the plurality of electronic controllers 70 may remain electrically connected to the electrical power source 62 through the low current mode relay 76. After a predetermined period of time, the relay controller 78 may communicate a deactivation command to the low current mode relay 76, thus completely disconnecting the plurality of electronic controllers 70 from the electrical power source 62.

According to an additional example, the operator may leave the machine 10 idling, with the ignition key switch 30 in an on position, for an extended period of time. After the engine electronic controller 44, or other controller, detects an idling state for a predetermined period of time, the engine electronic controller 44 may initiate an automatic engine shutdown, as is known in the art. After detecting the automatic engine shutdown, such as by receipt of a signal from the engine electronic controller 44, the relay controller 78 may be configured to communicate a deactivation command to the main power relay 72, such as after a predetermined period of time, to electrically disconnect the plurality of electronic controllers 70, and switched power components 102, from the electrical power source 62 through the main power relay 72. Thereafter, the relay controller 78 may communicate a deactivation command to the low current mode relay 76, thus opening the low current mode relay 76 and electrically disconnecting the plurality of electronic controllers 70 from the reduced current of electrical power provided along the fourth electrical circuit 74.

It should be appreciated that the electrical power system 60 and methods described herein may reduce the quiescent power draw of the electrical power source 62 when the ignition key switch 30 is in an off position, or when an automatic engine shutdown is detected. Specifically, for example, when the internal combustion engine 20 is off and the electrical power source 62 is not being continuously charged, at least a portion of the electronic controllers of electronic control system 42 may be switched to a reduced current draw of electrical power. Thereafter, those electronic controllers may be electrically disconnected from the electronic power source 62. Such a strategy may reduce the often significant quiescent power draw caused by electronic controllers and, further, may reduce the occurrence of such quiescent power draw depleting the electrical power source 62, leaving the operator unable to start the machine 10.

What is claimed is:

1. A machine, comprising a plurality of electronic controllers electrically connected to an electrical power source along a first electrical circuit through a main power relay and along a second electrical circuit through a low current mode relay, and each of the electronic controllers including a processor, a memory and an input/output circuit in communication with another one of the electronic controllers, wherein electrical power provided along the second electrical circuit provides a current draw to the electronic controllers that is less than a current draw provided to the electronic controllers along the first electrical circuit; and a relay controller electrically connected to the electrical power source along a third electrical circuit, the relay controller being in communication with the main power relay and the low current mode relay;

wherein the relay controller is configured to open and close the main power relay responsive to an ignition key switch being in an off position and an on position, respectively;

the relay controller is configured to open the low current mode relay a time period after the main power relay is opened, and configured to close the low current mode relay in response to the ignition key switch being in an on position, wherein the time period is selected to allow completion of procedures running on the electronic controllers.

2. The machine of claim 1 including a plurality of switched power components that are electrically connected to the electrical power source through the main power relay.

3. The machine of claim 2, wherein the relay controller is electrically connected to the electrical power source along a fourth electrical circuit through the ignition key switch.

4. The machine of claim 2 including a machine body that supports an engine; and wherein the relay controller is further configured to open the main power relay in response to an automatic engine shutdown signal.

5. The machine of claim 2, wherein the relay controller is further configured to close at least one of the main power relay and the low current mode relay in response to a wake up signal transmitted from a wake up component to the relay controller.

6. The machine of claim 1, wherein a first electronic controller of the plurality of electronic controllers includes a direct electrical connection to the electrical power source, the relay controller being in communication with the first electronic controller.

7. A method of operating a machine, comprising:

supplying electrical power from an electrical power source directly to a relay controller, while a plurality of electronic controllers are electrically disconnected from the electrical power source to, at least partially, reduce a quiescent power draw when an ignition key switch is in an off position;

receiving a power requirement indication;

communicating a first activation command from the relay controller to a main power relay in response to the power requirement indication;

closing the main power relay to electrically connect the electrical power source and the plurality of electronic controllers in response to the first activation command;

communicating between the plurality of electronic controllers after the plurality of electronic controllers are connected to the electrical power source;

communicating a second activation command from the relay controller to a low current mode relay in response to the power requirement indication;

closing the low current mode relay to electrically connect the electrical power source and the plurality of electronic controllers through the low current mode relay in response to the second activation command; and providing a current draw to the electronic controllers along the second electrical circuit that is less than a current draw provided to the electronic controllers along the first electrical circuit.

8. The method of claim 7, wherein the receiving step includes either one of detecting an on position of the ignition key switch of the machine and receiving a wake up signal from a wake up component.

9. The method of claim 1, further including:

detecting an off position of an ignition key switch of the machine;

communicating a first deactivation command from the relay controller to the main power relay in response to detecting the off position; and opening the main power relay to electrically disconnect the electrical power source and the plurality of electronic controllers through the main power relay in response to the first deactivation command.

10. The method of claim 9, further including:

communicating a second deactivation command from the relay controller to the low current mode relay a predetermined period of time after communicating the first deactivation command; and opening the low current mode relay to electrically disconnect the electrical power source and the plurality of electronic controllers through the low current mode relay in response to the second deactivation command.

11. The method of claim 1, further including:

detecting an automatic engine shutdown signal;

shutting down an engine of the machine responsive to the automatic engine shutdown signal;

communicating a first deactivation command from the relay controller to the main power relay in response to detecting the automatic engine shutdown signal; and opening the main power relay to electrically disconnect the electrical power source and the plurality of electronic controllers through the main power relay in response to the first deactivation command.

12. The method of claim 11, wherein the step of communicating the first deactivation command is performed a predetermined period of time after detecting the automatic engine shutdown signal.

13. The method of claim 11, further including:

communicating a second deactivation command from the relay controller to the low current mode relay a predetermined period of time after communicating the first deactivation command; and opening the low current mode relay to electrically disconnect the electrical power source and the plurality of electronic controllers through the low current mode relay in response to the second deactivation command.

14. An electronic control system of a machine, comprising:

a plurality of electronic controllers electrically connected to an electrical power source along a first electrical circuit through a main power relay and along a second electrical circuit through a low current mode relay, and each of the electronic controllers including a processor, a memory and an input/output circuit in communication with another one of the electronic controllers, wherein electrical power provided to the electronic controllers along the second electrical circuit provides a current draw that is less than a current draw provided to the electronic controllers along the first electrical, circuit; and a relay controller having a direct electrical connection to the electrical power source along a third electrical circuit and being electrically connected to the electrical power source along a fourth electrical circuit through an ignition key switch, the relay controller being in communication with the main power relay and the low current mode relay;

wherein the relay controller is configured to close at least one of the main power relay and the low current mode relay in response to detection of either an on position of the ignition key switch or receipt of a wake up signal transmitted from a wake up component.

15. The electronic control system of claim 14, wherein the relay controller is further configured to open at least one of the main power relay and the low current mode relay in response to detection of either an off position of the ignition key switch or detection of an automatic engine shutdown signal.

* * * * *